US007625251B2

(12) United States Patent
Martin et al.

(10) Patent No.: US 7,625,251 B2
(45) Date of Patent: Dec. 1, 2009

(54) CONNECTOR WITH REDUNDANT TERMINAL LOCKING

(75) Inventors: Galen M Martin, Camp Hill, PA (US); Matthew F Foriska, Girard, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/860,755

(22) Filed: Sep. 25, 2007

(65) Prior Publication Data

US 2009/0081908 A1 Mar. 26, 2009

(51) Int. Cl.
*H01R 13/514* (2006.01)

(52) U.S. Cl. ..... 439/752; 439/871

(58) Field of Classification Search ..... 439/752, 439/701, 871

See application file for complete search history.

(56) References Cited

U.S. PATENT DOCUMENTS 5,004,436 A * 4/1991 Aoyama ..... 439/752
5,562,495 A * 10/1996 Kakitani et al. ..... 439/595
6,817,901 B2 * 11/2004 Nishide ..... 439/595
6,827,609 B1 12/2004 Martin et al.
7,252,556 B2 * 8/2007 Anbo et al. ..... 439/752
2003/0211785 A1 11/2003 Fujita et al.
2004/0235365 A1 * 11/2004 Fujita ..... 439/752

FOREIGN PATENT DOCUMENTS

EP 0 836 251 A2 4/1998
EP 1 408 588 A1 4/2004

OTHER PUBLICATIONS

MQS Socket Housing—Customer Drawing dated Apr. 16, 1999.
11 Position Plug Housing—Customer Drawing dated Jan. 24, 2002.
PCT International Search Report; International Application No. PCT/US2008/010941; International Filing Date Sep. 18, 2008.

* cited by examiner

*Primary Examiner*—Tho D Ta
*Assistant Examiner*—Travis Chambers

(57) ABSTRACT

A connector is disclosed. The connector includes a connector housing having a terminal channel and a terminal positioned within the terminal channel. The connector includes a primary locking mechanism including a locking beam configured to engage a first terminal locking surface and a secondary locking mechanism including a locking hinge having a locking foot configured to engage a second terminal locking surface. The locking hinge is configured to pivot from a staging position to permit passage of the terminal into the connector through the terminal channel to an operative position to retain the terminal within the terminal channel and establish a position of maximum rearward travel of the terminal within the terminal channel.

13 Claims, 6 Drawing Sheets

CONNECTOR WITH REDUNDANT TERMINAL LOCKING

FIELD

The present disclosure is directed to electrical connectors and more particularly to connectors that isolate and retain multiple terminals.

BACKGROUND

In current connector systems that use a plastic latch for primary terminal retention, the plastic latch often serves as the sole locking feature. Thus, if the latch breaks during assembly or use, the terminal can slide about within the connector or even slip out of the connector completely. This results in undesirable performance and may lead to complete failure of the electrical connection accomplished with the connector.

This can be particularly problematic in sealed connectors, such as those used in the automotive and aviation industries, that are subjected to rigorous assembly and operating conditions. Despite the exposure to rigorous conditions, sealed connectors generally present complex tooling requirements and little available open space within the connector that further complicates efforts to adequately retain terminals in the connector.

What is needed is a connector system that introduces a secondary locking feature to provide for a redundancy to achieve more reliable terminal retention.

SUMMARY OF THE INVENTION

According to an exemplary embodiment of the invention, a connector includes a connector housing including a main connector housing and a secondary connector housing. A terminal channel extends through the connector and a terminal is positioned within the terminal channel. The connector includes a primary locking mechanism having a locking beam configured to engage a first terminal locking surface to retain the terminal within the terminal channel. The connector also includes a secondary locking mechanism including a locking hinge having a locking foot configured to engage a second terminal locking surface. The locking hinge is configured to pivot from a staging position to permit passage of the terminal into the connector through the terminal channel to an operative position to retain the terminal within the terminal channel and establish a position of maximum rearward travel of the terminal within the terminal channel.

According to another exemplary embodiment of the invention, a connector housing comprises a main connector housing and a secondary connector housing attached thereto and a terminal channel extending through the main and secondary connector housings. The connector housing further includes a locking beam positioned within the terminal channel and configured to retain a terminal therein and a locking hinge in the secondary connector housing. The locking hinge has a locking foot and is configured to pivot from a staging position to permit passage of a terminal into the connector housing through the terminal channel to an operative position configured to retain a terminal within the terminal channel and establish a position for maximum rearward travel of the terminal within the terminal channel. The locking beam is configured to engage a first terminal locking surface and the locking foot is configured to engage a second terminal locking surface. The locking beam and the locking foot are aligned within the terminal channel when the locking hinge is in its operative position.

An advantage of exemplary embodiments of the invention is that terminal position assurance is accomplished through the use of a secondary locking feature which provides an added level of terminal retention within the connector.

Another advantage of exemplary embodiments of the invention is that the secondary locking feature can be pivoted from a staged position to a locked, operative position to facilitate assembly of a connector fully inserted with terminals.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Exemplary embodiments of the invention are directed to connectors having primary and secondary locking features to retain a particular terminal within a connector housing. The secondary locking feature also provides terminal positioning assurance, assisting in both the proper positioning of the terminal within the connector and in securing the terminal within the connector housing.

Figure 1:
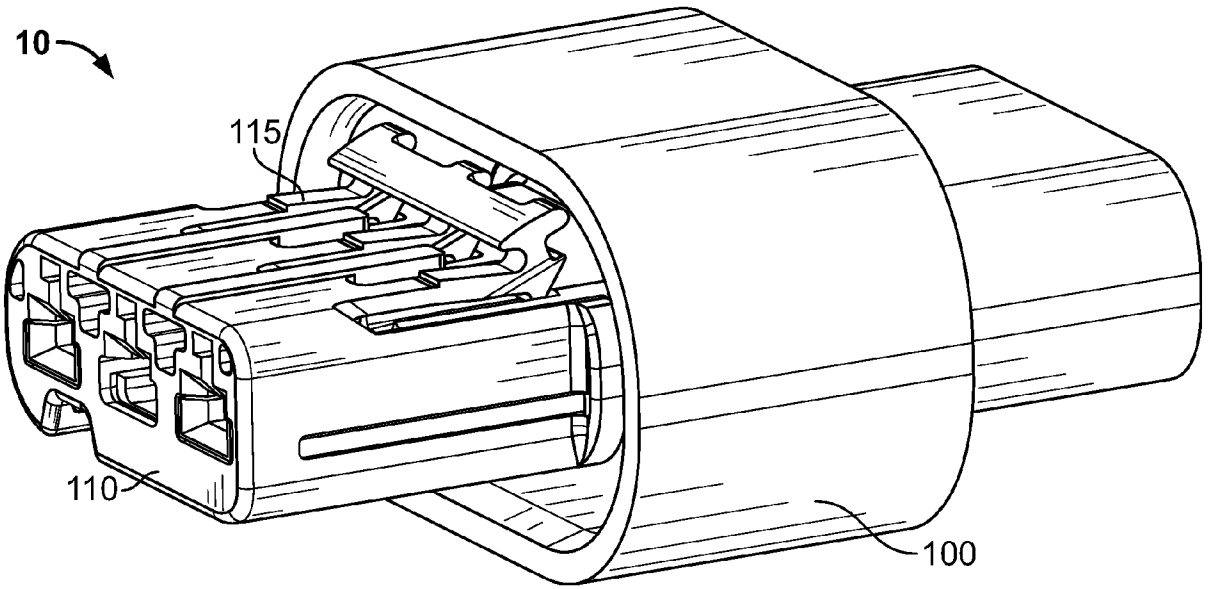
FIG. 1 illustrates a perspective view of a connector in accordance with an exemplary embodiment.
Figure 2:
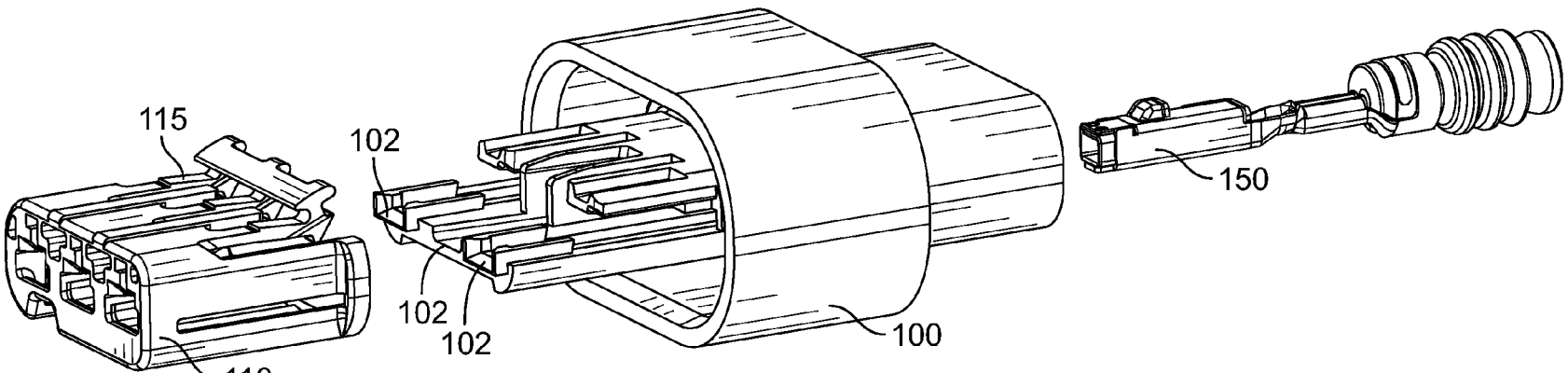
FIG. 2 illustrates an exploded view of the connector of FIG. 1.

Referring to FIG. 1, a connector 10 is shown that includes a connector housing having a main connector housing 100 and a secondary connector housing 110 that has a locking hinge 115. As better seen in the exploded view in FIG. 2, the main connector housing 100 includes a terminal support 102 in which one or more terminals 150 can be seated. The terminals 150 can be used to terminate wires (not shown) that extend rearwardly from the terminals 150 to a wire harness or other device.

The terminals 150 are generally metal or some other electrically conductive material. The main and secondary connector housings 100, 110 can be plastic or some other electrically insulating material and may be manufactured using injection molding techniques. When attached, the two housings 100, 110 surround the terminals 150. In sealed embodiments, as will be discussed in more detail later, the terminals 150 can be clean body terminals to reduce sharp edges that may puncture the seal.

In one embodiment, the secondary connector housing 110 is stirrup-shaped to slide over the terminal support 102 and attach to the main connector housing 100. Any suitable method of permanently or removably attaching the two connector housings 100, 110 can be used. These include snap or interference fit, glue, welding or a combination thereof, by way of example only.

Figure 3:
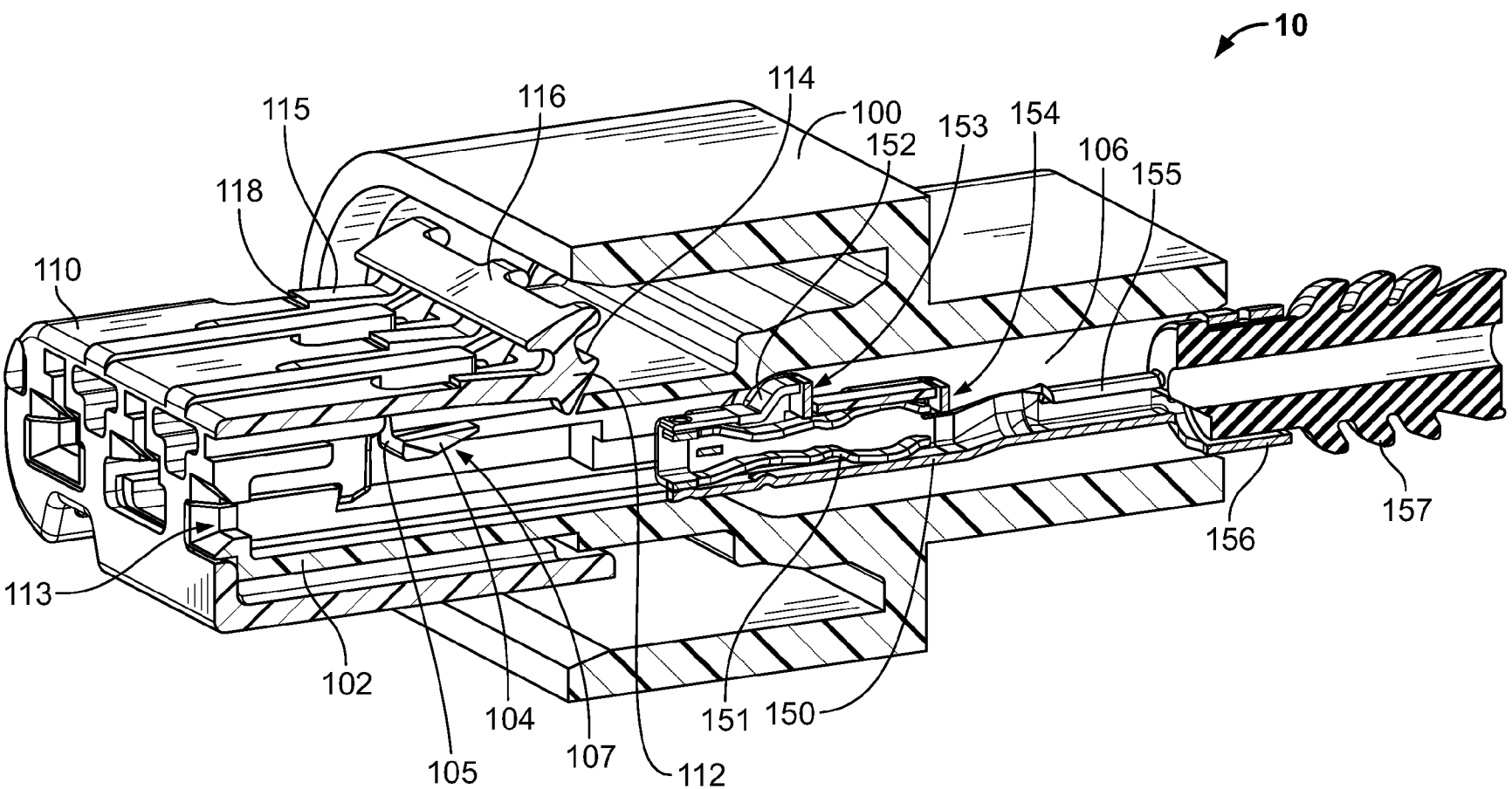
FIG. 3 is a partial perspective cross-sectional view of the connector of FIG. 1, showing a partially inserted terminal.
Figure 4:
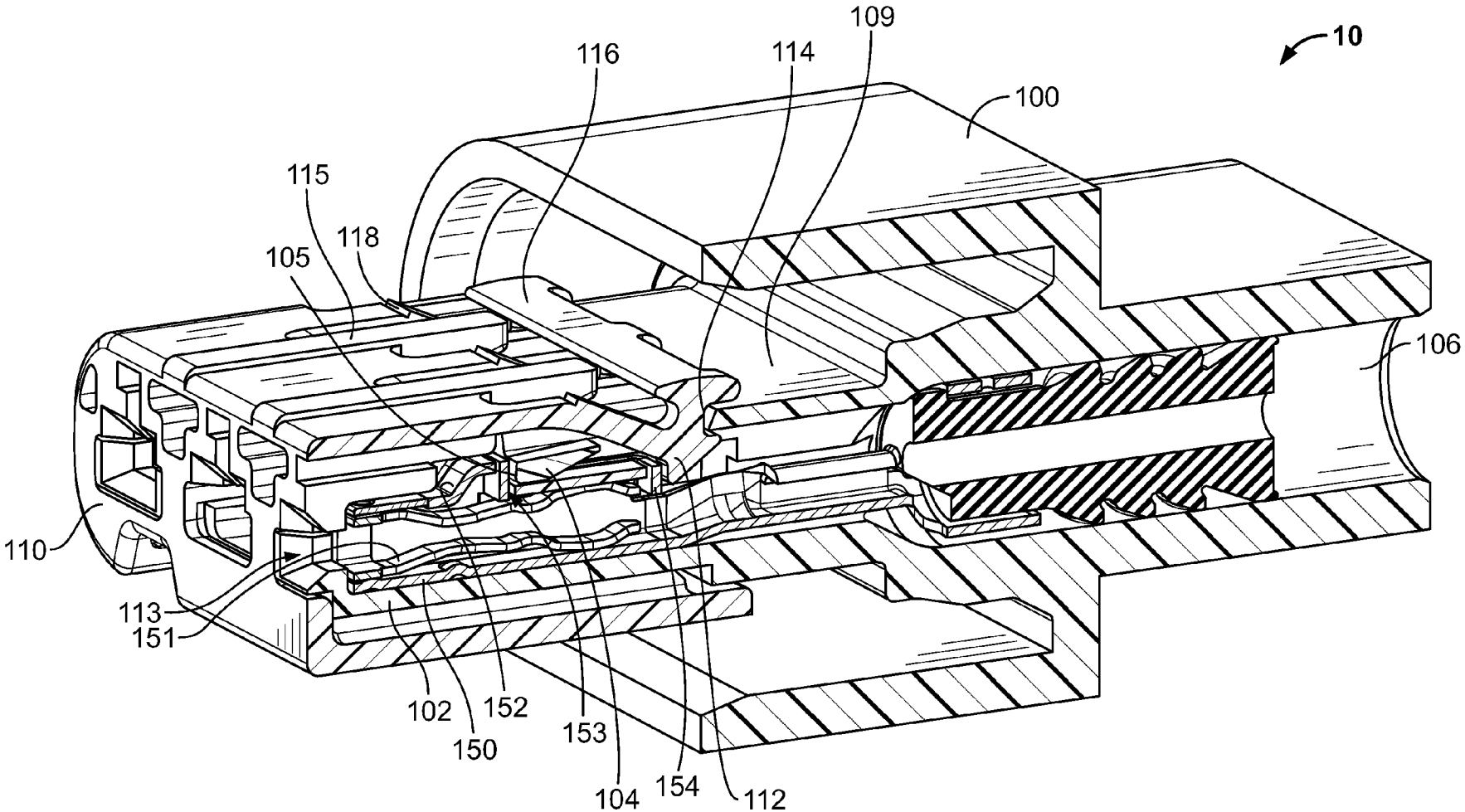
FIG. 4 is a partial perspective cross-sectional view of the connector of FIG. 1, showing a fully inserted terminal.

FIGS. 3 and 4 are partial cross-sectional views with the terminal 150 partially and fully inserted, respectively. The terminal 150 can be a terminal box containing one or more contact beams 151 to receive a corresponding pin 324 (FIG. 5) of a mating connector 320 to be connected with the connector 10. The terminal may also include an inclined protrusion 152 or other orienting feature, which may be advantageous for properly orienting the terminal 150 within the connector 10. The terminal 150 may further include a wire crimp section 155 to attach an exposed wire to the terminal 150 and an insulation crimp 156 that may be crimped around an unstripped section of wire to further secure it to the terminal 150. A seal 157 may also be provided which acts as a gasket to prevent moisture from entering the connector 10 from the rear, which may be advantageous in automotive or other sealed connectors that are exposed to the environment.

A terminal channel 106 formed in the main connector housing 100 provides a continuous passageway to receive the terminal into the connector 10. The terminal channel 106 extends from the rear of the connector, where the terminal 150 enters, to a pin aperture 113 in the front of the connector 10 provided to receive a mating terminal, such as a pin or other male member into the terminal 150. The terminal channel 106 can be formed entirely by the main connector housing 100 or the main connector housing 100 and the secondary connector housing 110 can together form a portion or all of the terminal channel 106 when the two are attached. The size and geometry of the terminal channel 106 may be selected to match the terminal 150.

A locking beam 104 of the connector and a first terminal locking surface 153 of the terminal provide a primary locking mechanism to retain the terminal 150 within the connector 10. The locking beam 104 engages the terminal 150 and is shown in this embodiment as a wedge formed integral with the main connector housing 100 and extending downward into the terminal channel 106. As the terminal 150 is forced through the terminal channel 106 from a partially inserted (FIG. 3) to a fully inserted (FIG. 4) position, the terminal's inclined protrusion 152 forces an opposing beveled surface 107 of the locking beam 104 upward, thus using the terminal's orienting feature to engage the locking beam 104. Once the inclined protrusion 152 of the terminal 150 passes the locking beam 104, the upward force on the locking beam 104 is removed and it returns to its original position within the channel 106. The locking beam 104 is then behind a rear wall of the terminal protrusion 152. As a result, the rear wall of the terminal 150 provides the first terminal locking surface 153 which opposes or is otherwise engaged by a front surface 105 of the locking beam 104.

The connector 10 also includes a secondary locking mechanism that comprises a locking hinge 115 having a locking foot 112 to engage a second terminal locking surface 154. The locking hinge 115 is integral with the secondary connector housing 110. The locking hinge 115 is movable from a staged position during terminal insertion (FIG. 3) to an operative position to lock the terminal 150 in place after terminal insertion (FIG. 4).

After the terminal 150 has been inserted past the locking beam 104 to its fully inserted position, the locking hinge 115 can be moved from its staging position to its operative position by pressing down on a leverage platform 116 of the hinge 115 that causes the hinge 115 to flex at hinge points 118 on the secondary connector housing 110. This forces the locking foot 112 behind a rear wall of the terminal 150, which serves as the second terminal locking surface 154. The locking foot 112 can be aligned with the locking beam 104 within the terminal channel 106 when the locking hinge 115 is in its operative position. The locking foot 112 provides a redundant, independent locking mechanism in addition to the primary locking mechanism that further decreases the likelihood that the terminal 150 will be unintentionally removed from the connector 10 during use.

The secondary locking mechanism also provides terminal position assurance by establishing a maximum distance of rearward travel of the terminal 150 within the terminal channel 106. For example, in some cases it may be difficult to determine whether the terminal 150 has been fully inserted. The locking foot 112 can be positioned to provide terminal position assurance, such that as long as the locking hinge 115 can be engaged to its operative position, a user is provided an assurance that the terminal 150 is sufficiently inserted within the terminal channel 106 to achieve satisfactory contact when the terminal receives a pin from a corresponding connector to which the connector 10 is mated. That is, if the terminal 150 is sufficiently inserted within the terminal channel 106 so that the locking foot 112 can engage the second terminal locking surface 154, a user is reasonably assured that the terminal 150 has been properly positioned. If the terminal 150 has not been fully inserted, depressing the locking hinge 115 toward its operative position may cause the locking foot 112 to urge the terminal 150 to its fully inserted position.

To retain the locking hinge 115 in its operative position, and thus maintain the locking foot 112 engaged with the second terminal locking surface 154, a retention notch 114 is provided in the locking hinge 115 that permits a snap-fit with a corresponding ledge 109 extending from the main connector housing 100. When the retention notch 114 engages the main connector housing 100, the locking hinge 115 is prevented from returning to the staging position. It will be appreciated however, that the locking hinge 115 may be maintained in its operative position through the use of glue, welding, or other methods of attachment solely or in combination with the retention notch 114.

Figure 5:
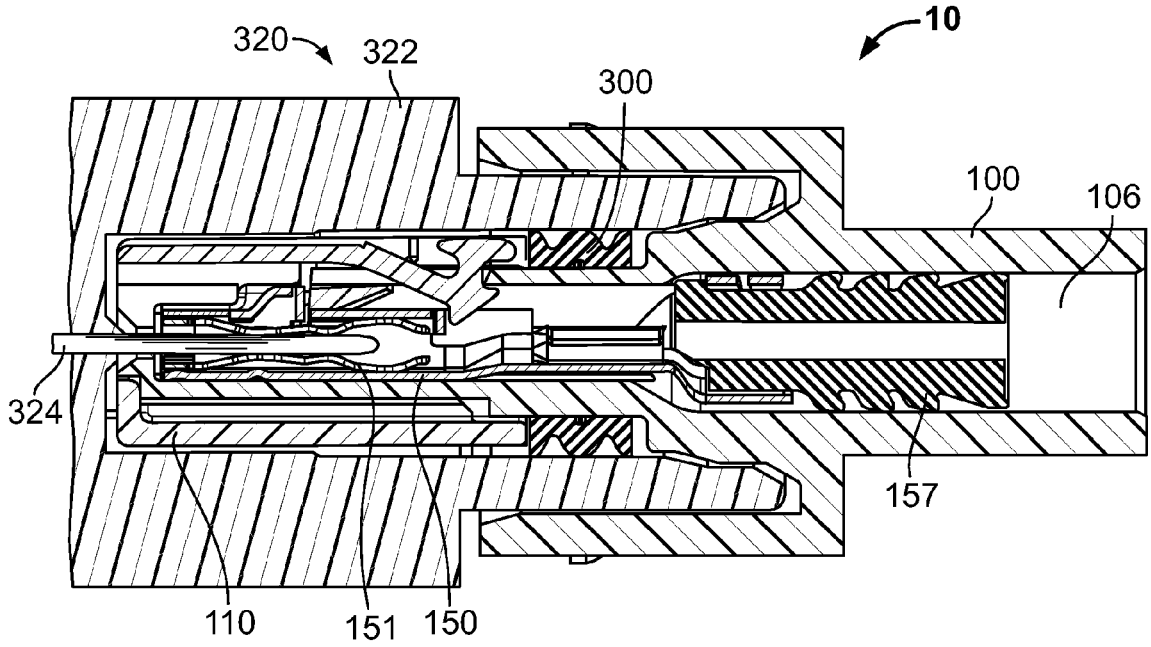
FIG. 5 is a side view of a sealed connector pair in accordance with an embodiment of the invention.
Figure 6:
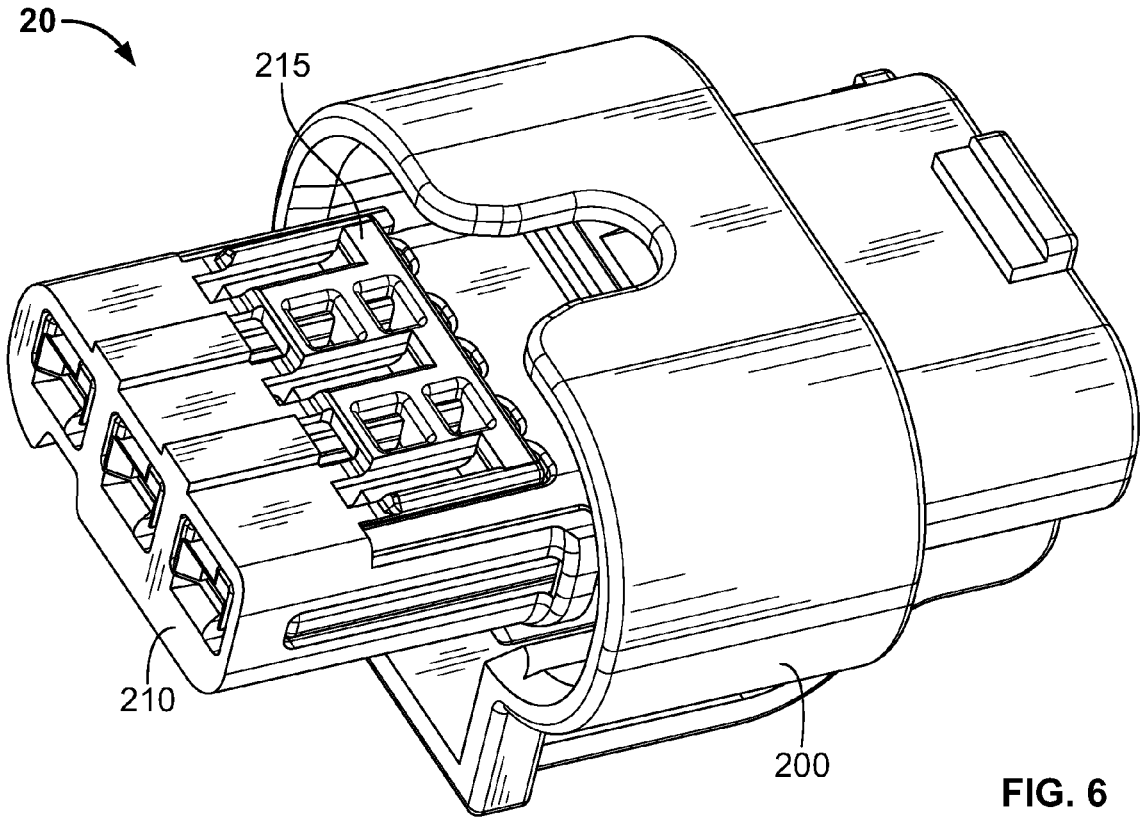
FIG. 6 is a perspective view of a connector in accordance with another exemplary embodiment.
Figure 7:
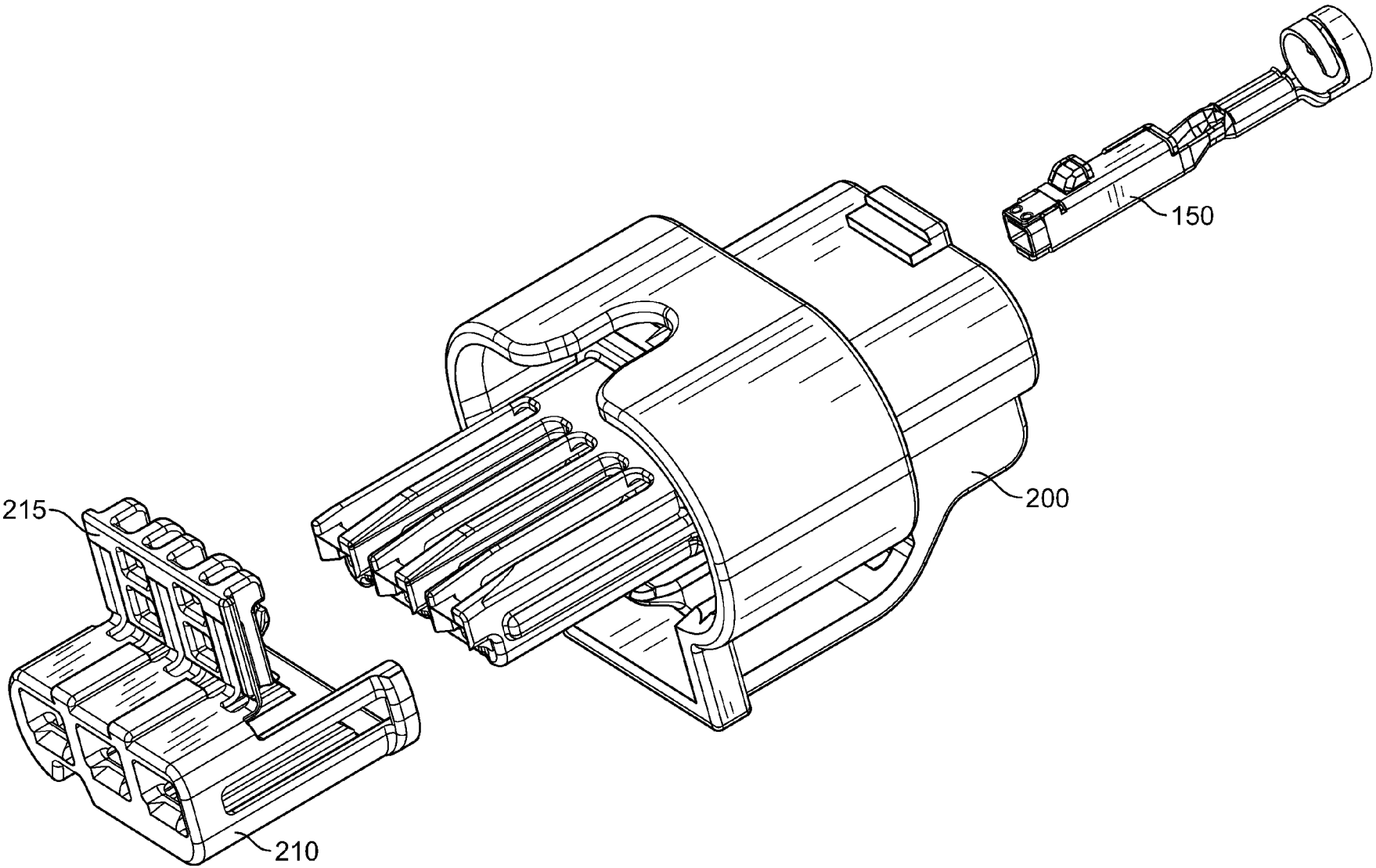
FIG. 7 illustrates an exploded view of the connector of FIG. 7.

FIG. 5 illustrates a first connector 10 in accordance with an exemplary embodiment of the invention mated to a second connector 320, which may be any connector that matingly corresponds to the first connector 10. The second connector 320 includes a pin 324 which is received by the terminal contacts 151 of the first connector 10 to complete an electrical circuit. As illustrated, a seal 300 is positioned between a body portion 322 of the second connector 320 and main connector housing 100 of the first connector 10, which in combination with the terminal seal 157 in the terminal channel 106 provides a sealed connector 10.

FIGS. 6-9 illustrate a connector 20 according to another exemplary embodiment of the invention. The connector 20 includes a main connector housing 200 and a secondary connector housing 210 which are connectable to one another and includes a terminal channel 206 extending therethrough to receive the terminal 150. In this embodiment, both the locking beam 204 and the locking foot 212 are provided as part of the locking hinge 215 in the secondary connector housing 210. Thus, after the terminal 150 has been fully inserted within the terminal channel 206, rotating the locking hinge 215 about the hinge point 218 from a staging position to an operative position accomplishes both the primary and the secondary locking of the terminal 150 within the connector

Figure 8:
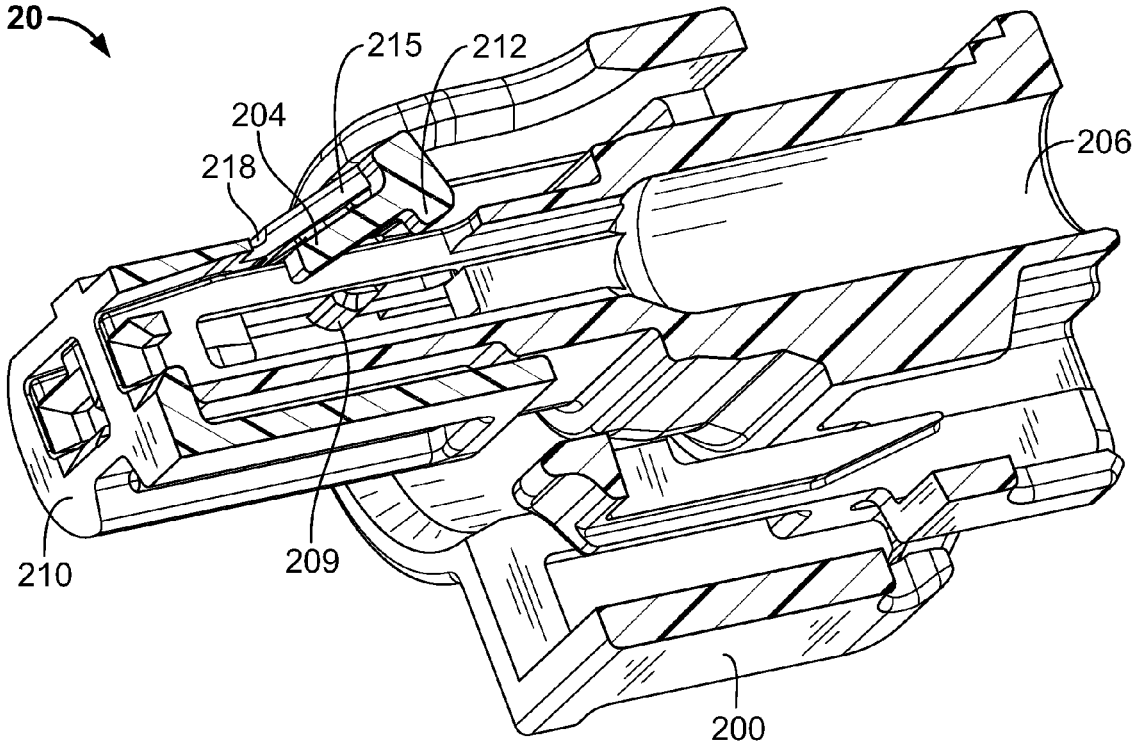
FIG. 8 is a partial perspective cross-sectional view of the connector of FIG. 7.
Figure 9:
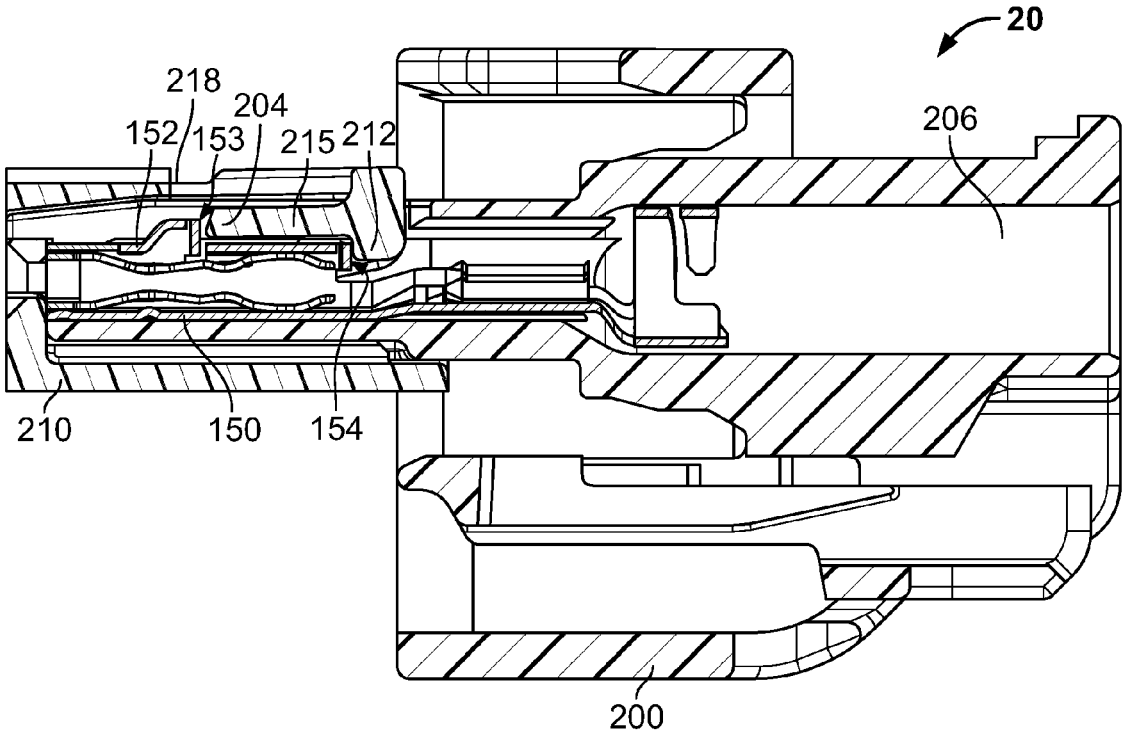
FIG. 9 is an elevation cross-sectional view of the connector of FIG. 7.

20. As shown on FIG. 9, when the locking hinge 215 is rotated into the operative position, locking beam 204 is engaged with primary terminal locking surface 153 to provide the primary locking mechanism and locking foot 212 is engaged with secondary terminal locking surface 154 to provide the secondary locking mechanism. FIG. 8 illustrates that the secondary connector housing 210 may include one or more staging tabs 209 to keep the locking hinge 215 in the staging position until an external force is applied to direct the hinge 215 into its operative position.

It will be appreciated that any form of geometry may be provided in the terminal 150 and/or the connector housings 100, 110 to provide primary and secondary locks and corresponding locking surfaces to retain the terminal within the connector. For example, if the terminal 150 does not contain an orienting feature, a rear surface of the terminal could serve as both the first and the second locking surfaces. Likewise, instead of a protrusion, the orientation feature could instead be a detent with a primary lock having a corresponding geometry. Furthermore, while embodiments may be shown or described with respect to a positive or male attribute for connection with a negative or female attribute, it is contemplated that embodiments could equally be created instead through the substitution of negative or female attributes configured for connection to a positive or male attribute.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A connector comprising:

a connector housing, having a terminal channel extending therethrough, including a main connector housing and a secondary connector housing;

a terminal positioned within the terminal channel;

a primary locking mechanism comprising a locking beam configured to engage a first terminal locking surface to retain the terminal within the terminal channel; and a secondary locking mechanism comprising a locking hinge having a locking foot configured to engage a second terminal locking surface, the locking hinge configured to pivot from a staging position to permit passage of the terminal into the connector through the terminal channel to an operative position to retain the terminal within the terminal channel and establish a position of maximum rearward travel of the terminal within the terminal channel, wherein the locking hinge includes both the locking beam and the locking foot, wherein the secondary connector housing includes the locking hinge.

2. The connector of claim 1, wherein the locking beam and the locking foot are aligned within the terminal channel when the locking hinge is in its operative position.

3. The connector of claim 1, wherein the locking hinge includes means to secure the locking hinge in its operative position.

4. The connector of claim 3, wherein the means to secure the locking hinge is a retention notch in the locking hinge configured to engage a corresponding ledge extending from the main connector housing.

5. The connector of claim 1, wherein the terminal includes an orienting feature.

6. The connector of claim 5, wherein a surface of the orienting feature is the first terminal locking surface and wherein a rear surface of the terminal provides the second terminal locking surface.

7. A sealed connector comprising:

a connector housing having a terminal channel extending therethrough, the connector housing having a main connector housing and a secondary connector housing attached thereto;

a clean body terminal positioned within the terminal channel;

a first seal positioned within the terminal channel;

a second seal positioned over an outer surface of the connector housing;

a primary locking mechanism comprising a locking beam configured to engage a first terminal locking surface to retain the terminal within the terminal channel; and a secondary locking mechanism comprising a locking hinge having a locking foot configured to engage a second terminal locking surface, the locking hinge configured to pivot from a staging position to permit passage of the terminal into the connector through the terminal channel to an operative position to retain the terminal within the terminal channel and establish a position of maximum rearward travel of the terminal within the terminal channel, wherein the secondary connector housing includes the locking hinge and wherein the locking hinge is movable from the staging to the operative position without relative movement between the main connector housing and the secondary connector housing.

8. The connector of claim 7, wherein the main connector housing includes the locking beam.

9. The connector of claim 7, wherein the secondary connector housing includes the locking beam.

10. The connector of claim 7, wherein the locking hinge includes means to secure the locking hinge in its operative position.

11. The connector of claim 7, wherein the locking hinge includes means to retain the locking hinge in its staging position in the absence of an applied force to the locking hinge.

12. The connector of claim 7, wherein the terminal includes an orienting feature, wherein a surface of the orienting feature provides the first terminal locking surface and wherein a rear surface of the terminal provides the second terminal locking surface.

13. The connector of claim 12, wherein the locking beam and the locking foot are aligned within the terminal channel when the locking hinge is in its operative position.

* * * * *